United States Patent [19]

Arai

[11] 3,958,481

[45] May 25, 1976

[54] APPARATUS FOR CUTTING A MOVING OBJECT INTO A PREDETERMINED LENGTH

[75] Inventor: Mamoru Arai, Gifu, Japan

[73] Assignee: Eisai Co., Ltd., Tokyo, Japan

[22] Filed: July 10, 1975

[21] Appl. No.: 594,650

[30] Foreign Application Priority Data

July 20, 1974 Japan ..... 49-83343

[52] U.S. Cl. ..... 83/311; 83/315; 83/321

[51] Int. Cl.[2] ..... B26D 1/56

[58] Field of Search ..... 83/311, 315, 316, 317, 83/321, 327, 328

[56] References Cited

UNITED STATES PATENTS

| | | | |
|---|---|---|---|
| 951,840 | 3/1910 | Peterson | 83/321 X |
| 2,802,431 | 8/1957 | Hoagland et al. | 83/321 X |
| 3,516,313 | 6/1970 | Gudmestad | 83/317 X |

*Primary Examiner*—Frank T. Yost

*Attorney, Agent, or Firm*—Woodhams, Blanchard and Flynn

[57] ABSTRACT

An apparatus for cutting a moving object into pieces of a fixed length, wherein an upper cutter base disposed at a specified distance from a lower cutter base is installed on the upper portion of rods supported to be vertically movable through vertical holes formed in the lower cutter base which is supported transversely on the frame in a rotatable fashion, said upper and lower cutter bases are respectively equipped with the upper and lower cutters confronting each other, the lower ends of said rods are pivotally connected to eccentric positions on the crank discs which are supported vertically on the frame in a rotatable fashion, and said crank discs are rotated by a driving mechanism.

3 Claims, 10 Drawing Figures

APPARATUS FOR CUTTING A MOVING OBJECT INTO A PREDETERMINED LENGTH

BACKGROUND OF THE INVENTION

The present invention relates to an apparatus for cutting a moving object into pieces of a fixed length.

The present invention relates particularly to a cutting apparatus suitable for obtaining an ampoule case having a fixed length by cutting a corrugated case band in which ampoules are accommodated.

Heretofore, as an apparatus for cutting a moving corrugated case band to obtain an ampoule of fixed length, an apparatus of a type in which a clutch is used to operate a Thomson cutter by means of a high-speed rotatable shaft, and an apparatus of a type in which a pair of upper and lower rotary cutters are operated, have been available.

However, in the former apparatus, there are drawbacks that the cutters are of a large size and accordingly a large driving force is required and also vibration is great, while in the latter, there are drawbacks that not only the cutters per se are expensive but also they are required to be changed to cutters having sizes suitable for each cutting length and therefor it is extremely inconvenient.

An object of the present invention is to provide an apparatus for cutting a certain object into pieces of a fixed length which is capable of eliminating those drawbacks brought about by the conventional apparatuses as mentioned in the foregoing.

Another object of the present invention is to provide an apparatus for cutting a certain object into pieces of a fixed length which renders it possible to perform exact cutting even when operated at high speed, wherein an upper cutter base disposed at a specified distance from a lower cutter base is installed on the upper portion of rods which are supported to be vertically movable through vertical holes formed in the lower cutter base which is supported transversely on the frame in a rotatable fashion, said upper and lower cutter bases are respectively equipped with the upper and lower cutters confronting each other, the lower ends of said rods are pivotally connected to eccentric positions on the crank discs which are supported vertically on the frame in a rotatable fashion, and said crank discs are rotated by a driving mechanism, whereby the cutters are supposed to be raised gradually from the state of being inclined backward in concert with the movement of the object while approaching to the object so as to perform the cutting almost perpendicularly, and then come to detach from the object while increasing the degree of forward inclination thereof gradually.

A further object of the present invention is to provide an apparatus for cutting a certain object into pieces of a fixed length, wherein a follower crank arm is installed on the end of a follower shaft for rotating said crank disc member, a main driving shaft is installed concentrically with said follower shaft, a main crank arm is installed on the end of said main driving shaft by leaving a specified space relative to said follower crank arm, a block member disposed midway between both crank arms is installed at an eccentric position on the main crank arm, a connecting member is equipped on said block member to be movable along it lengthways, said connecting member being held in the state of engagement with the follower crank arm, so that by changing the position of the connecting member, despite a fixed angular velocity of rotation of the main crank arm, the angular velocity of rotation of the follower crank arm can be appropriately altered and in its turn the operation period of the crank disc member as well as the cutter equipped thereon can be altered, thereby rendering it possible to adjust the cutting length of the object.

A still further object of the present invention is to provide an apparatus for cutting a certain object into pieces of a fixed length, wherein a differential gear assembly is employed as a mechanism for transmitting the motion of a shaft driven by a power source to the shaft for rotating the aforesaid crank disc member, the speed of rotation of the shaft for rotating the crank disc member is temporarily increased or decreased relative to the rotation of the shaft driven by a power source by the action of said differential gear assembly, whereby the operation period of the crank disc member as well as the cutter is temporarily altered and accordingly minute adjustments of the cutting length of the object can be performed.

BRIEF DESCRIPTION OF THE DRAWING

Referring to the accompanying drawings.

DETAILED DESCRIPTION OF THE INVENTION

Figure 1:
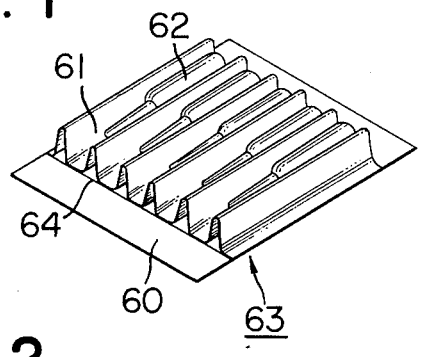
FIG. 1 is a perspective view of an ampoule case which is one example of the fixed-length product obtained by the cutting apparatus according to the present invention.

FIG. 1 shows the ampoule case 63 which is obtained by the use of the cutting apparatus according to the present invention, and said case 63 is formed by attaching a reverse surface of a valley portion of a corrugated paper 61 on a flat-shaped base paper 60, said valley portion accommodating the ampoule 62. The reference numeral 64 denotes a folding line formed on the base paper 60 and corresponding to both edges of the corrugated paper 61.

Figure 2:
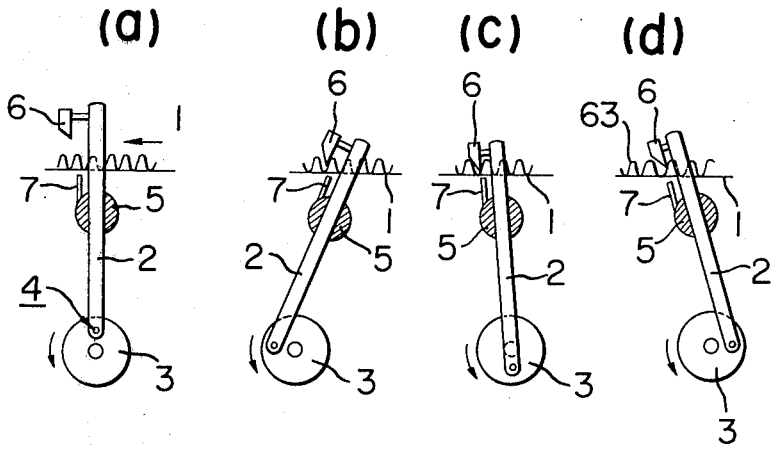
FIG. 2 is a diagrammatic representation of the sequence of motions which is illustrative of the principle of action of the cutting apparatus according to the present invention, and the motions of the present apparatus progress in alphabetical order, (*a*), (*b*), (*c*) and (*d*).

FIG. 2 is a diagrammatic representation of the sequence of motions which is illustrative of the principle of action of the cutting apparatus according to the present invention, and the motions of the present apparatus progress in alphabetical order of (*a*), (*b*), (*c*), (*d*) in the drawing. The reference numeral 1 herein denotes the ampoule case band which travels in the direction of arrow by means of a conveyer not shown in the drawing. Facing the top and bottom faces of the thus travelling band 1 are disposed the upper and lower cutters 6 and 7, respectively. The upper cutter 6 is fixed to the upper ends of the rods 2 whose lower ends are connected with the crank discs 3 and 3' by means of the pivot pins 4, said rod 2 being fitted in a hole formed in the lower cutter base 5 which is rotatably supported on the frame not shown in the drawing. The lower cutter 7 is installed on the lower cutter base 5 by so disposing as to confront the upper cutter 6.

Now, when the crank attains the upper dead point and the rod 2 becomes practically perpendicular as shown in FIG. 2 (*a*), the upper cutter 6 is located at the highest position thereof. Then, with the anticlockwise rotation of the crank disc 3 in the direction of arrow, the cutter 6 descends, the rod 2 inclines as shown in FIG. 2 (*b*), and accordingly, the lower cutter base also inclines, whereby the space between both cutters 6 and 7 is narrowed while are kept confronting each other.

When the crank attains the lower dead point with a further rotation of the crank disc 3, the rod 2 becomes practically perpendicular and the upper cutter 6 attains the lowest position thereof. At this, the upper cutter 6 cooperates with the lower cutter 7 to cut the band 1, and with successive rotation of the crank disc 3, as shown in FIG. 2 (*c*) and (*d*), the rod 2 inclines in the direction opposite to the direction at the time of descent of the cutter 6 and rises simultaneously until it returns to a position shown in FIG. 2 (*a*). In this way, the ampoule case 63 is obtained from the band 1.

On this occasion, it will do to omit the lower cutter 7 and employ a cutter cradle like the surface plate in place thereof.

Figure 3:
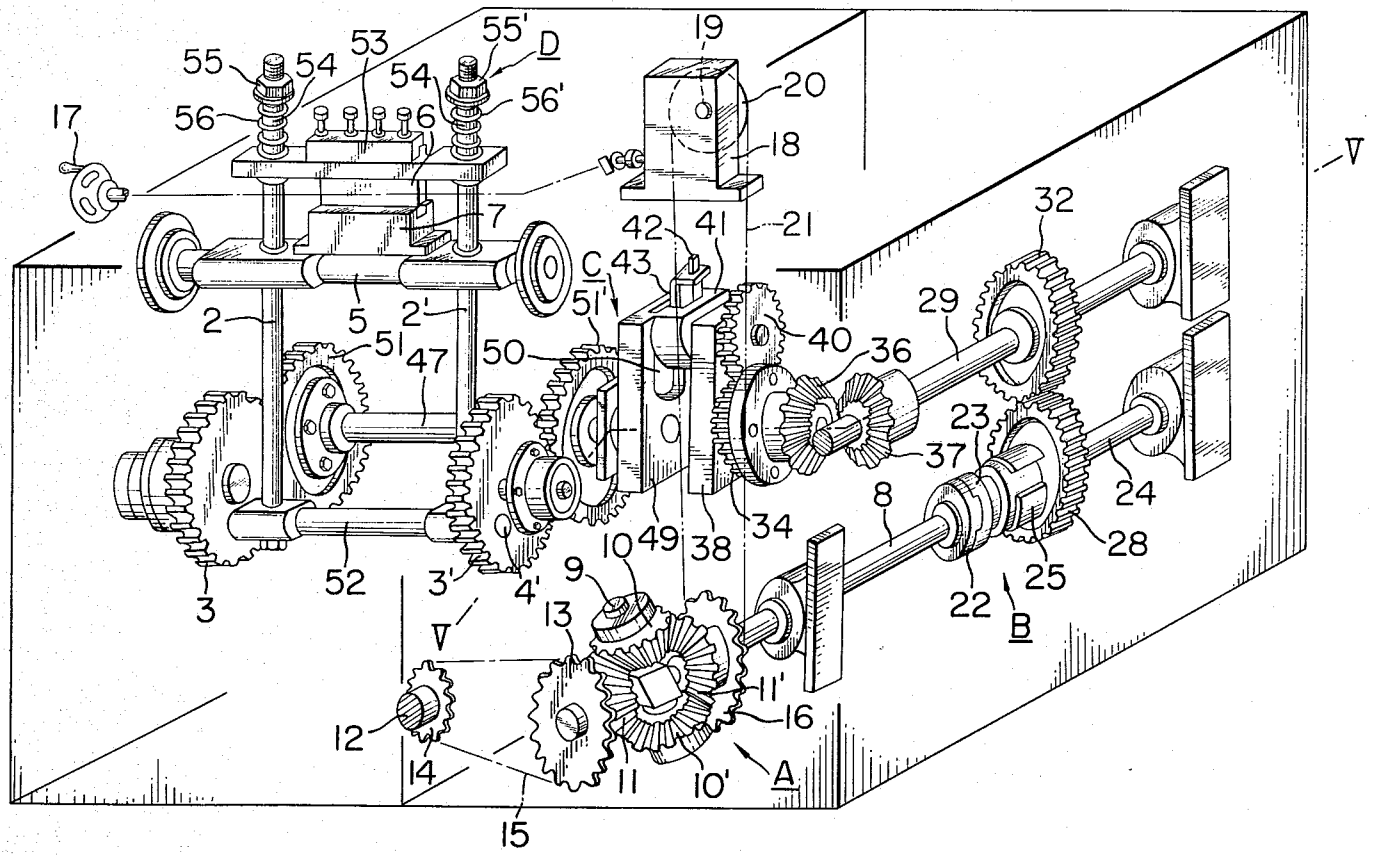
FIG. 3 is a perspective view of the internal structure of one embodiment of the cutting apparatus according to the present invention.

In FIG. 3 is shown the internal structue of one embodiment of the cutting apparatus to work according to the principle of action illustrated in FIG. 2.

This structure of cutting apparatus is broadly divided into a differential gear assembly A, a clutch assembly B, a differential transmission C and a cutting assembly D.

Figure 4:
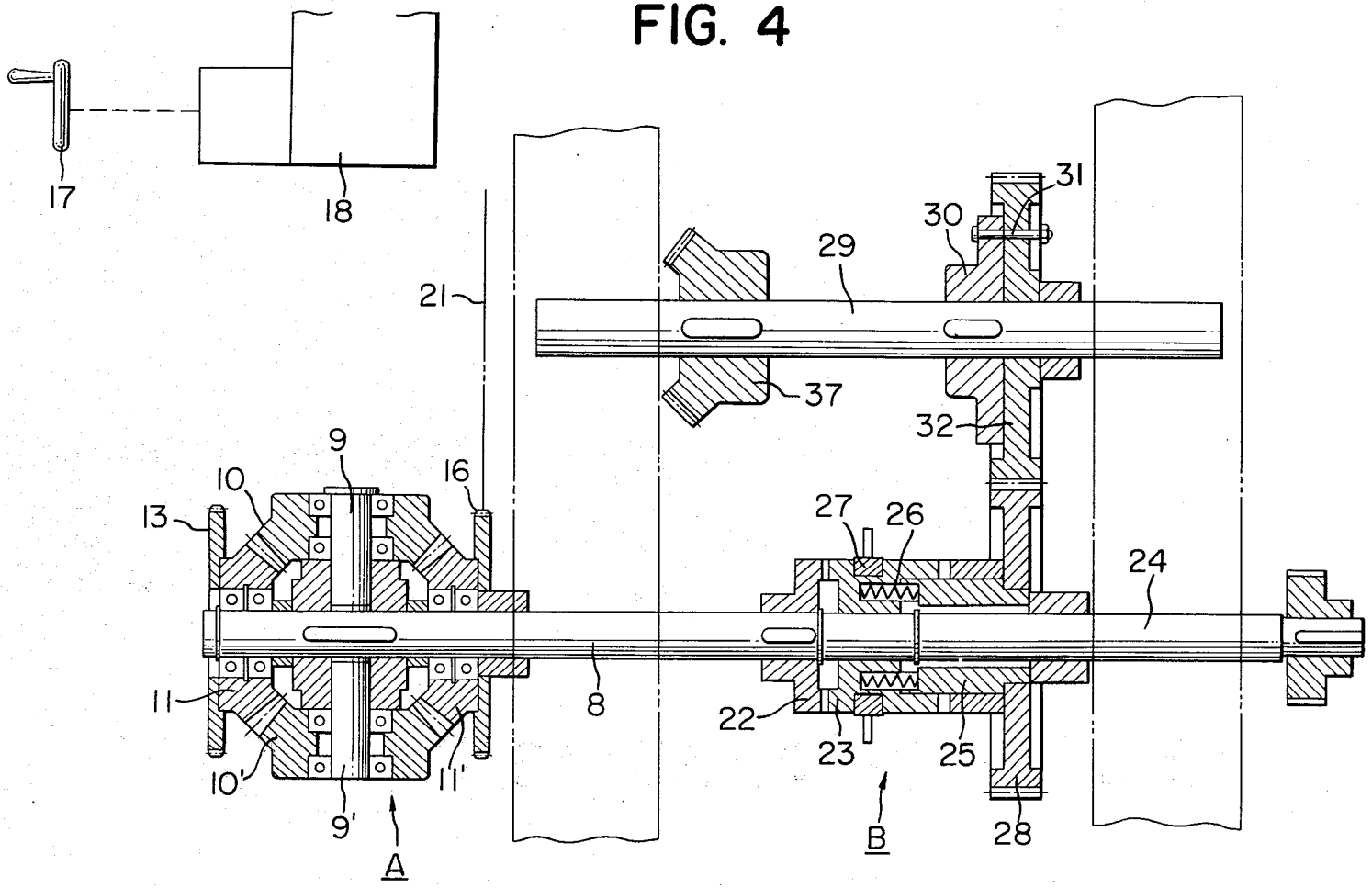
FIG. 4 is a partial cross-sectional view of the same embodiment as in FIG. 3, which is particularly illustrative of the differential gear assembly and the clutch assembly thereof.

As to the differential gear assembly A to begin with, in FIGS. 3 and 4, the reference numeral 8 denotes an input shaft supported rotatably on the frame, a couple of shafts 9 and 9' are perpendicularly installed on one end of said input shaft 8, said shafts 9 and 9' rotatably support the bevel gears 10 and 10', respectively, said bevel gears 10 and 10' engage with the bevel gears 11 and 11' which are rotatably supported on the input shaft 8.

On the bevel gear 11 is fixed the sprocket 13, said sprocket 13 being connected to the sprocket 14 fixed on the driving shaft 12 to be rotated by a driving source not shown in the drawing by means of the chain 15.

On the bevel gear 11' is fixed the sprocket 16, said sprocket 16 being connected to the sprocket 20 fixed on the output shaft 19 of the worm reduction gear 18 to be operated by the handle 17, by means of the chain 21.

Next, as to the clutch assembly B, in FIGS. 3 and 4, on the end of the input shaft 8 is fixed the flange 22 having a clutch member, and further the sleeve 23 having a clutch member on both ends thereof and adjoining said flange 22 is slidably fitted on said input shaft 8. Adjoining the sleeve 23, the sleeve 25 is rotatably fitted on the shaft 8, one end of said sleeve 25 being equipped with a clutch member. Between the sleeve 25 and sleeve 23 is stretched the compression spring 26, whereby the sleeve 23 is always biased to the side of flange 22 and the clutch members of the flange 22 and the sleeve 23 engage with each other. On the sleeve 23 is rotatably fitted the ring 27 with lever, and when the sleeve 23 is moved to the right in FIG. 4 in defiance to a force of the spring 26 by said ring 27, said sleeve 23 is released from engagement with the flange 22 and comes to engage with the sleeve 25. On the sleeve 25 is fixed the gear 28.

The gear 28 is engaged with the gear 32 which is united with the flange 30 fixed on the counter shaft 29 by means of the pin 31, said pin 31 being supposed to break when overloaded, thereby to release the connection between the flange 30 and gear 32 and ensure the safety of the apparatus.

Figure 5:
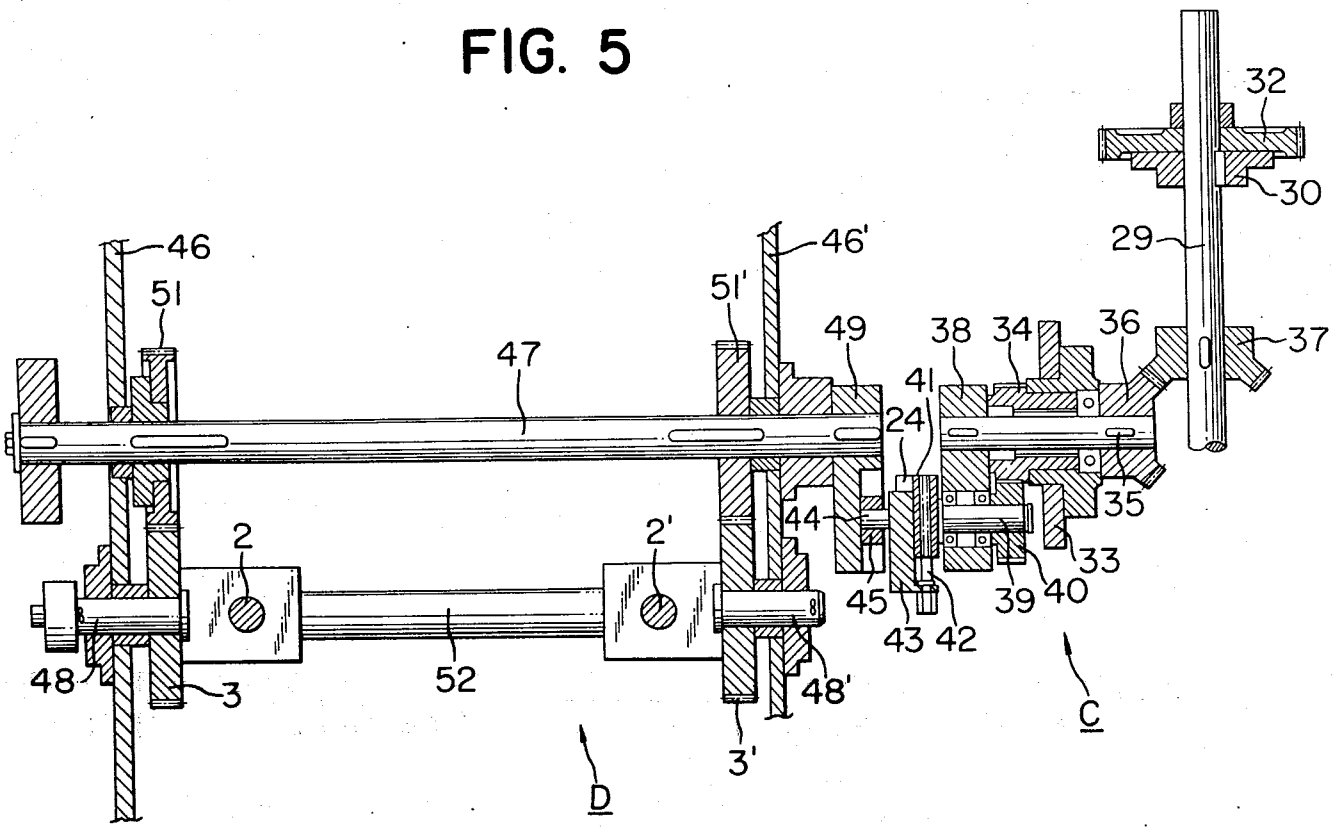
FIG. 5 is a cross-sectional view taken along the line V—V when the crank arm is disposed transversely in the embodiment shown in FIG. 3.

Next, as to the differential transmission C, in FIGS. 3 and 5, on the supporting frame 33 is fixed the sun gear 34 having a center hole and also is rotatably supported the shaft 35 of the bevel gear 36, said shaft 35 running through said center hold of the sun gear 34. The bevel gear 36 is engaged with the bevel gear 37 installed on the shaft 29. On the other end of the shaft 35 is installed the crank arm 38, and the shaft 39 is rotatably supported on said arm 38. On one end of the shaft 39 is installed the planetary gear 40 which is engaged with the gear 34. On the other end of the shaft 39 is installed the block 41 provided with a tapped hole into which the threaded shaft 42 is screwed. The threaded shaft 42 is rotatably supported on the top plate portion of the supporting member 43, and its head projects from said top plate portion to form a knob. The side plate portion of the supporting member 43 is slidably fitted in the groove 24 formed in the block 41, the pin 44 projects from the opposite side thereof, and the roller 45 is supported on said pin 44.

Figure 6:
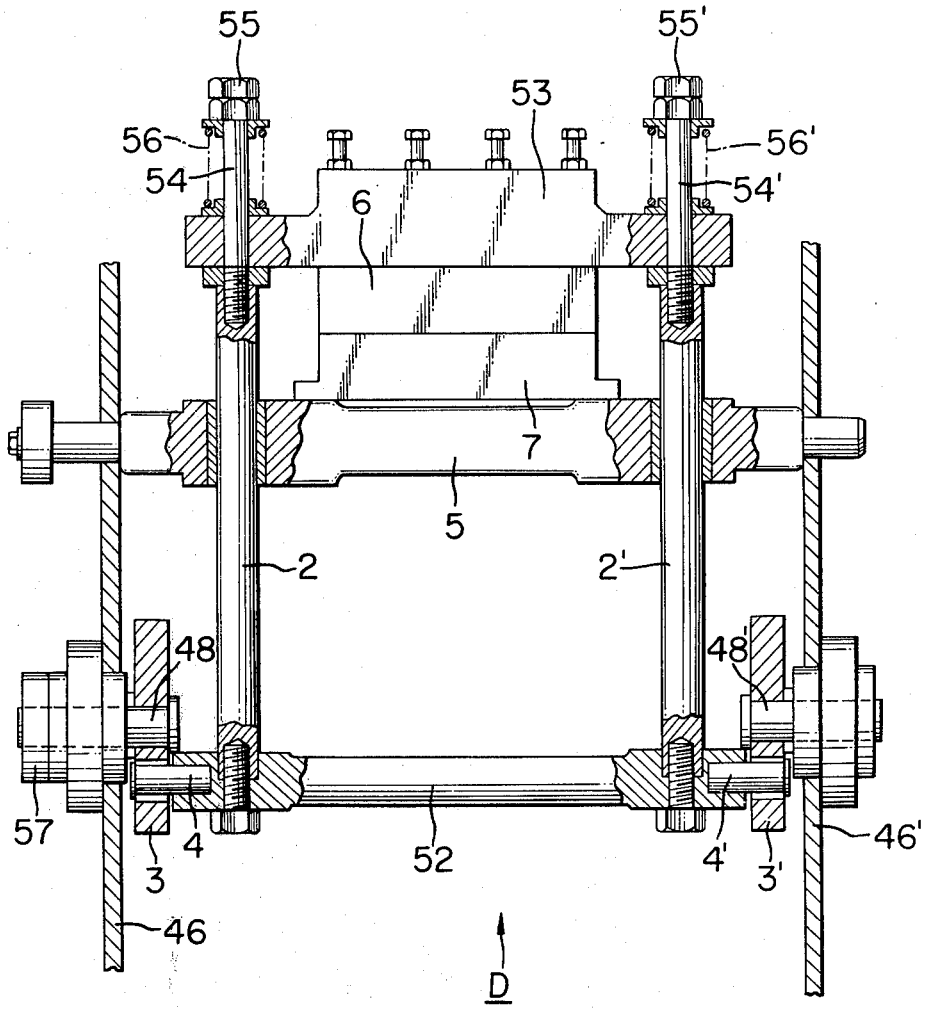
FIG. 6 is a partial cross-sectional view of the same embodiment as in FIG. 3, which is particularly illustrative of the cutting assembly thereof.

Lastly, as to the cutting assembly D, in FIGS. 3 and 6, the two end portions of the transverse shaft 47 are rotatably supported on the supporting frames 46 and 46', and the crank arm 49 is fixed on one end of said shaft 47 on the side of the differential transmission C. The recess 50 is provided for said crank arm 49 lengthways, and the aforesaid roller 45 is slidably fitted in this recess 50. On both sides of the shaft 47 are fixed a pair of gears 51 and 51', respectively, and the crank discs 3 and 3' are respectively fixed on the shafts 48 and 48' which are rotatably supported on the supporting frames 46 and 46'.

Between the confronting eccentric positions on the crank discs 3 and 3' is disposed the connecting bar 52 whose two ends 4 and 4' are pivotally supported on the crank discs 3 and 3', respectively (See FIG. 3). Near the two ends of said bar 52 are installed a pair of rods 2 and 2', said rods 2 and 2' being supported on the cutter base 5 as described in the foregoing, and on the cutter base 5 is installed the lower cutter 7. The upper cutter 7 confronting the lower cutter 7 is installed on the bottom of the upper cutter base 53. Both ends of the cutter base 53 are provided with a hole each, and these holes slidably fit on the auxiliary rods 54 and 54' installed on the top of the rods 2 and 2'. The top face of the upper cutter 6 is pressed down by means of the compression springs 56 and 56' controlled by the nuts 55 and 55'. In FIG. 6, the reference numeral 57 denotes the graduated dial plate installed on the outer extremity of the shaft 48 of the crank disc 3 and having graduation indicative of the lower dead point of the pivot pin 4, at which point the cutters 6 and 7 attain the state of being engaged with each other. Accordingly eventual replacement of the upper cutter at this stage may prevent the damage thereof.

Now, the operating condition of the foregoing apparatus will be explained hereunder.

The shaft 12 is rotated by a driving source not shown in the drawing, and the motion thereof is transmitted to the bevel gear 11, whereby the shaft 8 is rotated by means of the differential gear assembly A. On this occasion, when it is not desired to transmit the rotation of the shaft 8 to the gear 28, the sleeve 23 is moved to the right in FIG. 4 in defiance of the force of expansion of the spring 26 by means of the ring 27 with lever. At this, the clutch members of the flange 22 and sleeve 23 which have been engaged with each other come to be disengaged, and said transmission of rotation is suspended.

The foregoing rotation of the shaft 8 is transmitted to the counter shaft 29 through engagement of the gears 28 and 32 and subsequently transmitted to the shaft 35 through engagement of the bevel gears 36 and 37, thereby to rotate the crank arm 38 installed on said shaft 35. With the rotation of the crank arm 38, the planetary gear 40 installed on the shaft supported on said crank arm 38 engages with the sun gear 34 and revolves round the sun gear 34 while rotating on its own axis. By virtue of this rotation of the planetary gear 40, the block 41 installed on the shaft 39 also revolves in the same way while rotating on its own axis, and the roller 45 supported on said block 41 induces the crank arm 49 to rotate. The roller 45 is disposed at an axial position different from that of the shaft 39 by means of the threaded shaft 42, whereby the roller 45 rotates drawing an elliptical locus centering around the axis of the shaft 47, and accordingly, the rotary motion of the crank arm 49 becomes an ununiform motion.

The uniform rotary motion of the crank arm 49 as above is transmitted to the crank discs 3 and 3' through the shaft 47 and the gears 51 and 51', and by virtue of this motion, the rods 2 and 2' erected on the connecting bar 52 whose two ends are pivotally connected to the crank discs 3 and 3' make vertical movement as well as oscillatory movement with which the upper cutter 6 installed on the upper cutter base 53 supported on the rods 2 and 2' and the lower cutter 7 installed on the lower cutter base 5 make fixed movements. In this case, according to the position of the lower cutter base 5, the upper cutter 7 moves along a practically oval locus with peaked portion down. Further, by virtue of said ununiform rotary motion, the upper cutter 6 moves quicker as it nears the upper dead point and moves slower as it nears the lower dead point, and the cutting is performed by the upper and lower cutters 6 and 7 at the lower dead point.

The ampoule case band 1 is kept moving at a fixed speed by means of a conveyer not shown in the drawing during the foregoing cutting operation, and during thus moving, it is cut at the valley portion of the corrugated paper as shown in FIG. 2 (*c*), whereby the ampoule case 63 is obtained. The length of his ampoule case 63 must be varied with the size of the ampoule 62 to be accommodated therein; for instance, in the case where a couple of 20 ml-ampoules are to be accommodated, the length of the ampoule case 63 should be determined as 83 mm, while in the case where a couple of 10 ml-ampoules are to be accommodated, it should be determined as 67 mm.

The mechanism for use in altering the cutting length on such occasions as above is the differential transmission C. In this mechanism, at the time of altering the cutting length, the threaded shaft 42 is rotated, thereby screw it into or out from the block 41. By so doing, the supporting member 43 united with said block 41 en block and the roller 45 supported on said supporting member 43 approach to or separate from the shaft 47 along the length of the recess 50 of the crank arm 49, whereby the position of the roller 45 relative to the shaft 47 is altered. This alteration of the position of the roller 45 relative to the shaft 47 brings on an alteration of the angular velocity of the shaft 47, leading to the alteration of the timing of the mode of movement of the upper and lower cutters 6 and 7 such as shown in FIG. 2, that is, the period of cutting by the cutters 6 and 7, and the cutting length of the ampoule case band 1 moving at a fixed velocity between them is altered. In this way, according to the present embodiment, the cutting length thereof can be modified in the range of from 60 to 90 mm.

In the case where the cutting length is altered as above, it often happens that the cutting position slips out of place, rendering it impossible to perform the cutting exactly at the valley portion of the ampoule case band. Therefore, with a view to overcoming such a drawback, the present invention is devised to be capable of minute adjustments of the cutting length in conformity with such alterations. The differential gear assembly A in the present invention is assigned for this very purpose.

Figure 7:
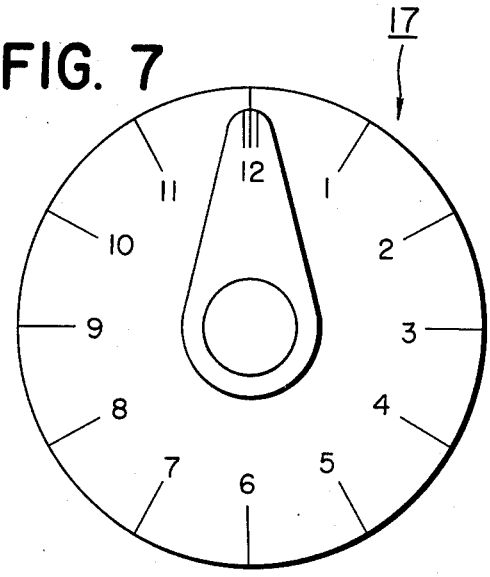
FIG. 7 is an enlarged front view of the knob for controlling the cutting length.

The adjustment in this case is performed by operating the handle 17. When the handle 17 is turned, the bevel gear 11' is rotated in the same direction or opposite direction relative to the direction of rotation of the input shaft 8 through the sprocket 20, chain 21 and sprocket 16, and the shaft 8 is temporarily accelerated or decelerated through the bevel gears 10 and 10' engaged with said bevel gear 11'. This temporary acceleration or deceleration of the shaft 8 is directly transmitted to the shafts 29 and 47, whereby an aberrancy of the timing of actuation of the upper and lower cutters 6 and 7 is brought on, minute adjustments of the cutting period of the ampoule case band 1 are effected to alter the cutting length temporarily, and in its turn, a correct position for cutting is ensured. In order to facilitate this operation, it is convenient to equip the handle 17 with a graduated dial plate 60 such as shown in FIG. 7.

In this connection, in the foregoing embodiment, as the reduction ratio of the input shaft and output shaft of the worm reduction gear 18 is set to be 40 and the reduction ratio of the sprockets 20 and 16 is set to be 3/2, when the cutting length of the ampoule case band 1 is 83 mm, $$\frac{83}{40 \times \frac{3}{2}} = 1.4 \text{ (mm)}.$$

That is, one rotation of the handle 17 renders a minute adjustment of 1.4 mm. By the same operation, when the cutting length is 67 mm, a minute adjustment of 1.1 mm can be performed.

Although a particular preferred embodiment of the invention has been disclosed hereinabove for the purpose of illustration, it will be understood that variations or modifications thereof which lie within the scope of the invention as defined by the appended claims are fully contemplated.

What is claimed is:

1. An apparatus for cutting a moving object into pieces of a predetermined length, comprising: a frame; a lower cutter base member which is transversely supported on said frame in a rotatable fashion and is provided with vertical holes running therethrough; an upper cutter base member which is disposed above said lower cutter base member at a specified distance and is supported on the upper part of rods which make vertical movement via said holes running through the lower cutter base member; a pair of upper and lower cutter members which are respectively installed on the upper and lower cutter base members and are disposed confronting each other so as to cooperate in cutting the object; a crank disc member which is vertically supported on said frame in a rotatable fashion and the lower ends of said rods are pivotally connected to eccentric positions thereon; and a driving mechanism for rotating said crank disc member.

2. An apparatus according to claim 1, wherein said driving mechanism comprises a follower driving shaft for rotating said crank disc member and is provided with a follower crank arm on the end portion thereof, a main driving shaft which is disposed confronting said follower driving shaft concentrically and whose end portion confronting the follower driving shaft is provided with a main crank arm which is disposed at a specified distance from said follower crank arm, a block member which is disposed in the middle of said two crank arms and is installed at an eccentric position on the main crank arm, and a connecting member which moves within said block member along both crank arms lengthways and is held in the state of connecting with the follower crank arm during thus moving.

3. An apparatus according to claim 1, wherein said driving mechanism employs a differential gear assembly as the mechanism for transmitting the motion of the shaft driven by a power source to the shaft for rotating said crank disc member, and the rotation of the shaft for rotating said crank disc member is temporarily accelerated or decelerated relative to the rotation of the shaft driven by a power source by actuating said differential gear assembly, thereby rendering it possible to perform minute adjustments of the timing of actuation of the cutters.

* * * * *